US011454238B2

(12) United States Patent
Jung et al.

(10) Patent No.: US 11,454,238 B2
(45) Date of Patent: Sep. 27, 2022

(54) COMPRESSOR WITH A DEFORMABLE GROOVE

(71) Applicant: LG Electronics Inc., Seoul (KR)

(72) Inventors: Taeksu Jung, Seoul (KR); Jonghun Ha, Seoul (KR); Kangwook Lee, Seoul (KR); Seungmock Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/153,431

(22) Filed: Jan. 20, 2021

(65) Prior Publication Data

US 2021/0246895 A1 Aug. 12, 2021

(30) Foreign Application Priority Data

Feb. 10, 2020 (KR) ..... 10-2020-0015502

(51) Int. Cl.

| | |
|---|---|
| ***F04C 18/02*** | (2006.01) |
| ***F04C 2/02*** | (2006.01) |
| ***F01C 17/06*** | (2006.01) |
| ***F04C 29/06*** | (2006.01) |
| ***F04C 29/00*** | (2006.01) |

(52) U.S. Cl.

CPC ..... *F04C 18/0253* (2013.01); *F01C 17/066* (2013.01); *F04C 2/025* (2013.01); *F04C 18/0215* (2013.01); *F04C 29/0021* (2013.01); *F04C 29/0057* (2013.01); *F04C 29/06* (2013.01); *F04C 2240/20* (2013.01); *F04C 2240/30* (2013.01); *F05B 2260/96* (2013.01)

(58) Field of Classification Search

CPC ..... F04C 18/0207–0292; F04C 2/025; F04C 29/005; F04C 29/0057; F04C 29/06; F01C 1/0207–0292; F01C 17/066

See application file for complete search history.

(56) References Cited

U.S. PATENT DOCUMENTS

2003/0175139 A1* 9/2003 Joo ..... F04C 28/28 418/55.3
2019/0345941 A1* 11/2019 Yoo ..... F04C 29/0071

FOREIGN PATENT DOCUMENTS

| | | | | |
|---|---|---|---|---|
| EP | 3199753 | A1 * | 8/2017 | ..... F04C 18/0215 |
| JP | 2003286974 | A * | 10/2003 | ..... F04C 18/0207 |
| KR | 20020063431 | A * | 8/2002 | |
| KR | 1020050043485 | | 5/2005 | |
| KR | 2012184774 | | 9/2012 | |
| KR | 102056378 | | 12/2019 | |
| WO | WO-2020209827 | A1 * | 10/2020 | ..... F01C 17/066 |

OTHER PUBLICATIONS

KR Office Action in Korean Appln. No. 10-2020-0015502, dated May 7, 2021, 9 pages (with English translation).

* cited by examiner

*Primary Examiner* — Laert Dounis
(74) *Attorney, Agent, or Firm* — Fish & Richardson P.C.

(57) ABSTRACT

A compressor includes a deformable groove spaced apart from a key groove and deformable to reduce an impact force or stress generated at an Oldham's ring.

23 Claims, 9 Drawing Sheets

FIG. 2A
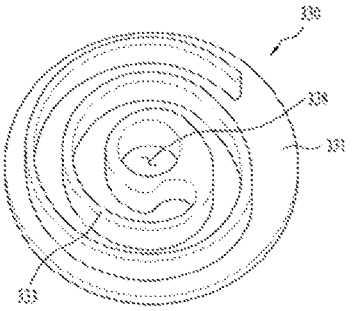
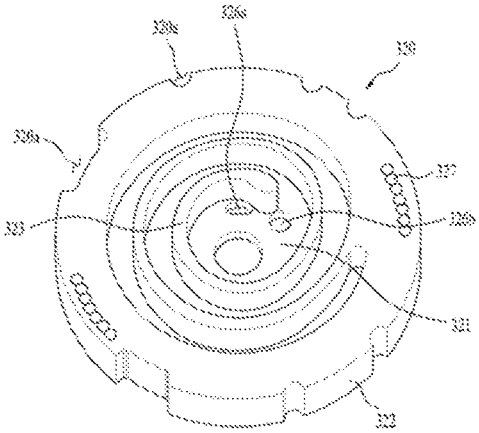
FIG. 2B
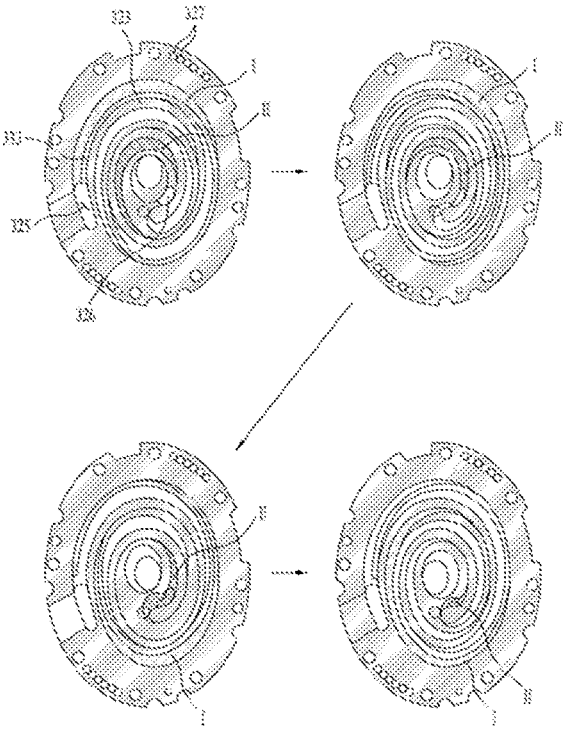
FIG. 2C

COMPRESSOR WITH A DEFORMABLE GROOVE

CROSS-REFERENCE TO RELATED APPLICATIONS

This application claims the benefit of Korean Patent Application No. 10-2020-0015502, filed on Feb. 10, 2020, which is hereby incorporated by reference as when fully set forth herein.

TECHNICAL FIELD

The present disclosure relates to a compressor. More specifically, the present relates to a compressor having a deformable groove to reduce a stress or impact force generated at the Oldham's ring.

BACKGROUND

Generally, a compressor is an apparatus applied to a refrigeration cycle such as a refrigerator or an air conditioner, which compresses refrigerant to provide work necessary to generate heat exchange in the refrigeration cycle.

The compressors may be classified into a reciprocating type, a rotary type, and a scroll type based on a scheme in which the refrigerant is compressed. Among these types, in the scroll type compressor, an orbiting scroll orbits around a fixed scroll while being engaged with the fixed scroll fixedly disposed in an internal space of a casing, and a compression chamber is defined between a fixed wrap of the fixed scroll and an orbiting wrap of the orbiting scroll.

Compared with other types of the compressor, the scroll type compressor may obtain a relatively high compression ratio because the refrigerant is continuously compressed through the scrolls engaged with each other, and may obtain a stable torque because suction, compression, and discharge cycles of the refrigerant proceed continuously. For this reason, the scroll type compressor is widely used for compressing the refrigerant in the air conditioner and the like.

A conventional scroll type compressor includes a casing forming an outer shape of the compressor and having a discharger for discharging refrigerant, a compression assembly fixed to the casing to compress the refrigerant, and a driver fixed to the casing to drive the compression assembly, wherein the compression assembly and the driver are coupled to a rotatable shaft that is rotatably coupled to the driver. In the conventional scroll compressor, the rotatable shaft is eccentric in a radial direction. The orbiting scroll is fixed to the eccentric rotatable shaft and is configured to orbit around the fixed scroll. As a result, the orbiting scroll orbits around the fixed wrap of the fixed scroll to compress the refrigerant.

In the conventional scroll compressor, the compression assembly is disposed under a refrigerant discharger, and the driver is disposed under the compression assembly. One end of the rotatable shaft is coupled to the compression assembly, while the other end thereof extends in a direction away from the refrigerant discharger and is coupled to the driver. Therefore, in the conventional scroll compressor, because the compression assembly is closer to the refrigerant discharger than the driver is (or the compression assembly is disposed above the driver), there is difficulty in supplying oil to the compression assembly. Further, an additional lower frame under the driver is required to separately support the rotatable shaft connected to the compression assembly. Further, in the conventional scroll compressor, because action points of a gas force generated via the compression of the refrigerant and a reaction force supporting the gas force do not coincide with each other within the compression assembly, the orbiting scroll tilts, resulting in a problem of lowering reliability.

In order to solve this problem, in recent years, a scroll compressor (referred to as a lower scroll compressor) is developed in which the driver is closer to the refrigerant discharger than the compression assembly is while the driver is disposed between the refrigerant discharger and the compression assembly.

In the lower scroll compressor, since a distal end of the rotatable shaft farthest from the refrigerant discharger is rotatably supported by the compression assembly, a lower frame may be omitted. Further, the oil stored in a lower portion of the casing is directly supplied to the compression assembly without passing through the driver, such that lubrication of the fixed scroll and the orbiting scroll may be performed quickly. Furthermore, when the rotatable shaft passes through the fixed scroll in the lower scroll compressor, the points of action of the gas force and the reaction force coincide with each other at the rotatable shaft, such that an upsetting moment of the orbiting scroll may be fundamentally removed.

Because in the lower scroll compressor, the driver is closer to the refrigerant discharger than the compression assembly is while the driver is disposed between the refrigerant discharger and the compression assembly, the orbiting scroll is adjacent to the refrigerant discharger, and the fixed scroll is farther from the refrigerant discharger than the orbiting scroll is. Since the refrigerant compressed in the compression assembly is discharged through the fixed scroll, the refrigerant must be discharged from the compression assembly in a direction away from the refrigerant discharger.

Therefore, the lower scroll compressor additionally includes a muffler which is coupled to the fixed scroll while the fixed scroll is disposed between the refrigerant discharger and the muffler. The muffler is configured for guiding the refrigerant discharged from the fixed scroll to the driver and the refrigerant discharger. The muffler defines a space in which the refrigerant discharged from the compression assembly may change a flow direction thereof. Thus, the muffler prevents the refrigerant discharged from the compression assembly from colliding with the oil stored in the casing, and may guide high-pressure refrigerant smoothly to the refrigerant discharger.

Further, the conventional scroll compressor further includes an Oldham's ring that prevents spinning of the orbiting scroll.

The Oldham's ring may switch the rotation of the orbiting scroll into four directions (front, rear, left, and right) to prevent spinning of the orbiting scroll. Therefore, an impact force or stress generated in the process of converting the rotation of the orbiting scroll to the four directions may be concentrated on the Oldham's ring, and thus, reliability thereof may be degraded.

Korean Patent Application Publication No. 2002-0063431 discloses support means formed in a key groove to which the Oldham's ring is coupled in order to ensure the reliability of the Oldham's ring. The support means includes a support plate in contact with the key of the Oldham's ring and a spring for elastically supporting the support plate, and thus reduces the impact force or stress generated between the key groove to which the Oldham's ring is coupled and the key of the Oldham's ring.

In this case, there may be a problem that a separate component must be installed in the key groove to the key of the Oldham's ring is coupled. Further, when considering the eccentric rotation of the scroll compressor, the impact force or stress acting between the key groove and the key is not uniformly distributed. Thus, it may be difficult to effectively reduce the impact force or stress acting between the key groove and the key. Further, the support means is installed only on one side of the key groove, so that the impact force or stress generated on the other side of the key groove is not reduced.

Related prior art literature: Patent Literature: Korean Patent Application Publication No. 2002-0063431.

SUMMARY

One embodiment of the present disclosure has a purpose to reduce the impact force or stress occurring in the Oldham's ring.

One embodiment of the present disclosure has a purpose to reduce the impact force or stress occurring in the Oldham's ring without an additional component.

One embodiment of the present disclosure has a purpose to efficiently reduce the impact force or stress generated in the Oldham's ring due to eccentric rotation.

One embodiment of the present disclosure has a purpose to dissipate the impact force or stress occurring in the Oldham's ring using deformation.

One embodiment of the present disclosure has a purpose to reduce the impact force or stress generated in the Oldham's ring using a moment caused by a pressure difference during an operation of the scroll compressor.

One embodiment of the present disclosure has a purpose to reduce the impact force or stress generated in the Oldham's ring to reduce a noise and tilting of the compressor.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

In order to achieve the purposes, in one embodiment of the present disclosure, a deformable groove may be defined in each of an orbiting scroll and a main frame.

In order to achieve the purposes, in one embodiment of the present disclosure, an elastic partition wall disposed between a key groove and a deformable groove is deformed within an elastic deformation limit, thereby to reduce the impact force to the Oldham's ring.

In one aspect of the present disclosure, a compressor includes a casing having a refrigerant discharger for discharging refrigerant; a driver coupled to an inner circumferential face of the casing to rotate a rotatable shaft; and a compression assembly coupled to the rotatable shaft to compress the refrigerant, wherein the compression assembly includes: an orbiting scroll coupled to the rotatable shaft and configured to perform an orbiting motion when the rotatable shaft rotates; a fixed scroll in engagement with the orbiting scroll to receive the refrigerant and compress and discharge the refrigerant; a main frame seated on the fixed scroll to accommodate the orbiting scroll therein, wherein the rotatable shaft passes through the main frame; and an Oldham's ring including a ring body disposed between the orbiting scroll and the main frame, and keys protruding from the ring body and coupled to the orbiting scroll and the main frame respectively to prevent spinning of the orbiting scroll, wherein each of the orbiting scroll and the main frame has a corresponding key groove to accommodate a corresponding key therein, wherein the corresponding key groove contacts the corresponding key when the rotatable shaft rotates, wherein a deformable groove is defined in at least one of the orbiting scroll and the main frame and is spaced apart from a corresponding key groove, and is deformable to reduce an impact force between the corresponding key and the corresponding key groove. Thus, the impact force generated at the Oldham's ring may be reduced.

In one implementation, the key groove has a contact point at which the key contacts an inner face of the key groove when the rotatable shaft rotates, wherein the deformable groove extends in a parallel manner to the key groove so that the deformable groove is deformed at the contact point thereof when the rotatable shaft rotates.

In one implementation, each of the key groove and the deformable groove is recessed in an axial direction of the shaft, wherein a depression of the key groove in the axial direction is smaller than a depression of the deformable groove in the axial direction.

In one implementation, the deformable groove has a length extending in a direction parallel to a radial length direction of the key groove, and has a width extending in the perpendicular direction to the length direction, wherein the length of the deformable groove is greater than the width thereof.

In one implementation, the deformable groove has a curved face to allow the deformable groove to be deformed when the rotatable shaft rotates.

In one implementation, the compression assembly further includes an impact-force dissipating member received in the deformable groove to absorb an impact force generated between the key and the key groove.

In one implementation, the key groove includes a contact point at which the key contacts an inner face of the key groove when the rotatable shaft rotates, wherein the impact-force dissipating member is in contact with the contact point.

In one implementation, the main frame includes: a main end plate through which the rotatable shaft passes; and a main side plate protruding from an outer circumferential face of the main end plate and seated on the fixed scroll, wherein the key groove includes a main key groove defined in the main end plate.

In one implementation, the main end plate has one face in contact with the ring body, an opposite face opposite to one face and spaced apart from the ring body, and an outer side face extending between one face and the opposite face, wherein the deformable groove includes a main deformable groove defined in the main end plate and extending in a parallel manner to the main key groove, wherein the main deformable groove is spaced apart from the outer side face.

In one implementation, the main key groove has: a first face constituting a plane; and a second face spaced apart from the first face and extending in a parallel manner to the first face, wherein the main deformable groove includes a first main deformable groove and a second main deformable groove, wherein the main key groove is disposed between the first main deformable groove and the second main deformable groove, wherein the first main deformable groove is closer to the first face than to the second face, and the second main deformable groove is closer to the second face than to the first face.

In one implementation, each of the first main deformable groove and the second main deformable groove extends from one end thereof to the other end thereof in a direction toward the outer side face, wherein a spacing between the other end of the first main deformable groove and the outer side face is different from a spacing between the other end of the second main deformable groove and the outer side face.

In one implementation, the orbiting scroll includes: an orbiting end plate disposed between the main frame and the fixed scroll; and an orbiting wrap extending from the orbiting end plate toward the fixed scroll to define a compression chamber together with the fixed scroll, wherein the refrigerant is compressed in the compression chamber, wherein the key groove includes an orbiting key groove defined in the orbiting end plate.

In one implementation, the orbiting end plate has: one face in contact with the ring body; an opposite face spaced apart from one face, wherein the orbiting wrap extends from the opposite face; and an outer side face extending between one face and the opposite face, wherein the deformable groove includes an orbiting deformable groove defined in the orbiting end plate and extending in a parallel manner with the orbiting key groove, wherein the orbiting deformable groove is spaced apart from the outer side face.

In one implementation, the orbiting end plate has: one face in contact with the ring body; an opposite face spaced apart from one face, wherein the orbiting wrap extends from the opposite face; and an outer side face extending between one face and the opposite face, wherein the deformable groove is defined in the orbiting end plate, extends in a parallel manner to the orbiting key groove, and passes through the outer side face.

In one implementation, the orbiting key groove has: a first face constituting a plane; and a second face spaced apart from the first face and extending in a parallel manner to the first face, wherein the orbiting deformable groove includes a first orbiting deformable groove and a second orbiting deformable groove, wherein the orbiting key groove is disposed between the first orbiting deformable groove and the second orbiting deformable groove, wherein the first orbiting deformable groove is closer to the first face than to the second face and extends from one end thereof to the other end thereof in a direction toward the outer side face, wherein the second orbiting deformable groove is closer to the second face than to the first face and extends from one end thereof to the other end thereof in a direction toward the outer side face, wherein a spacing between the other end of the first orbiting deformable groove and the outer side face is different from a spacing between the other end of the second orbiting deformable groove and the outer side face.

Effects of the present disclosure are as follows but are limited thereto.

According to the implementations of the present disclosure, the impact force or stress generated at the Oldham's ring may be reduced without an additional component.

According to the implementations of the present disclosure, even when the rotatable shaft rotates eccentrically such that the impact force is concentrated on a specific point of the Oldham's ring, the impact force concentrated on the specific point may be reduced in a targeted manner.

According to the implementations of the present disclosure, the tilting and noise generated in the compressor may be reduced.

BRIEF DESCRIPTION OF DRAWINGS

FIGS. 2A to 2C are diagrams showing an operating principle of a compression assembly according to one embodiment of the present disclosure.

DETAILED DESCRIPTIONS

Figure 1:
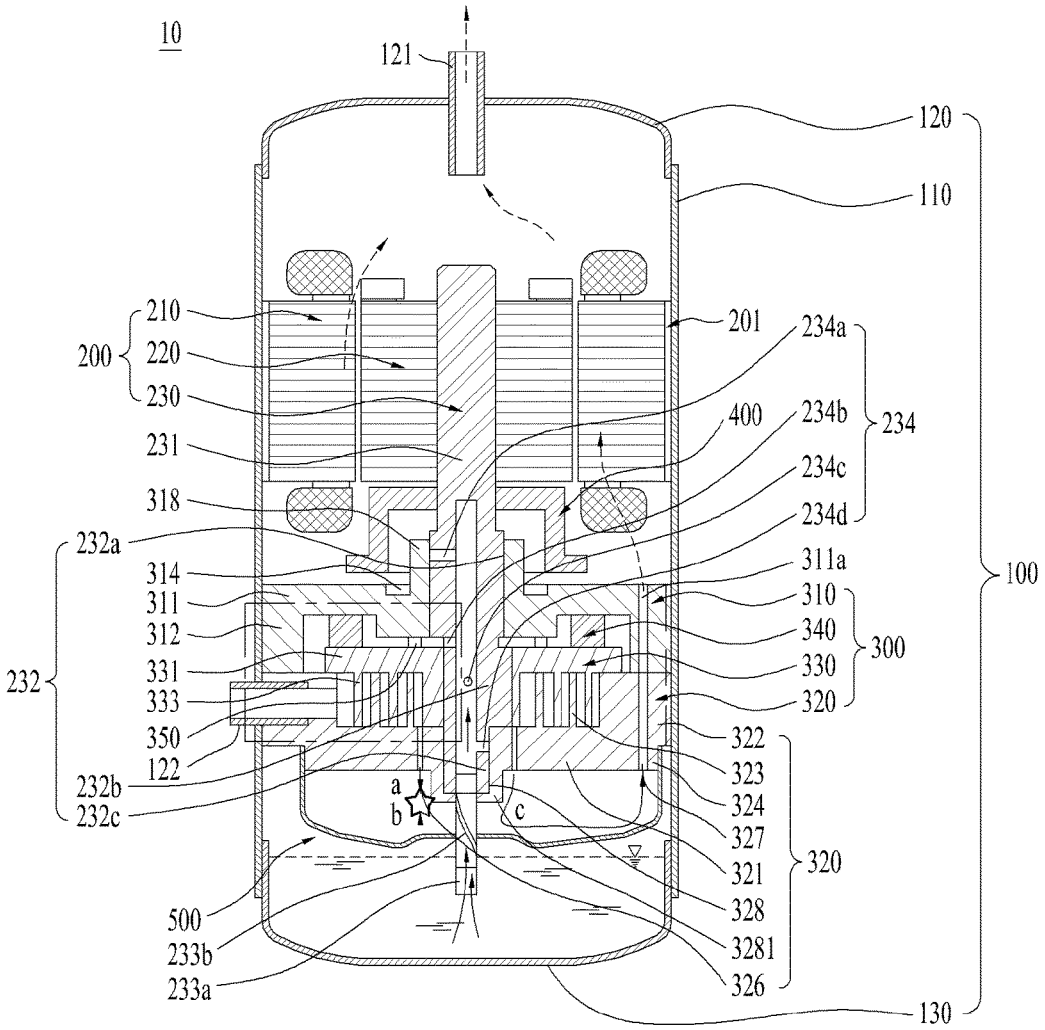
FIG. 1 is a diagram showing a lower scroll compressor according to one embodiment of the present disclosure.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the present disclosure to the specific embodiments as described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or greater of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a diagram showing a basic structure of a lower scroll compressor 10 according to one embodiment of the present disclosure.

Referring to FIG. 1, the lower scroll compressor 10 according to an embodiment of the present disclosure may include a casing 100 having therein a space in which fluid is stored or flows, a driver 200 coupled to an inner circumferential face of the casing 100 to rotate a rotatable shaft 230, and a compression assembly 300 coupled to the rotatable shaft 230 inside the casing and compressing the fluid.

Specifically, the casing 100 may include a refrigerant inlet 122 into which refrigerant is introduced and a refrigerant discharger 121 through which the refrigerant is discharged. The casing 100 may include a receiving shell 110 having a cylindrical shape and receiving the driver 200 and the compression assembly 300 therein, and having the refrigerant inlet 122, a discharge shell 120 coupled to one end of the receiving shell 110 and having the refrigerant discharger 121, and a sealing shell 130 coupled to the other end of the receiving shell 110 to seal the receiving shell 110.

The driver 200 includes a stator 210 for generating a rotating magnetic field, and a rotor 220 disposed to rotate by the rotating magnetic field. The rotatable shaft 230 may be coupled to the rotor 220 to be rotated together with the rotation of the rotor 220.

The stator 210 has a plurality of slots defined in an inner circumferential face thereof along a circumferential direction and a coil is wound in and along the plurality of slots, thereby to generate a rotating magnetic field. The stator may be fixedly disposed on the inner circumferential face of the receiving shell 110. The rotor 220 may have a plurality of magnets (permanent magnets) received therein configured to react to the rotating magnetic field. The rotor 220 may be rotatably accommodated inside the stator 210. The rotatable shaft 230 passes through a center of the rotor 220 and coupled thereto, so that when the rotor 220 rotates using the rotating magnetic field, the shaft 230 rotates together with the rotation of the rotor 220.

The compression assembly 300 may include a fixed scroll 320 fixed to the inner circumferential face of the receiving shell 110. The driver 200 is disposed between the refrigerant discharger 121 and the fixed scroll 320. The compression assembly 300 may include an orbiting scroll 330 coupled to the rotatable shaft 230 and engaged with the fixed scroll 320 to define a compression chamber. The compression assembly 300 may include a main frame 310 seated on the fixed scroll 320 and receive therein the orbiting scroll 330.

The lower scroll compressor 10 according to an embodiment of the present disclosure has the driver 200 disposed between the refrigerant discharger 121 and the compression assembly 300. Thus, when the refrigerant discharger 121 is disposed at a top of the casing 100, the compression assembly 300 may be disposed below the driver 200, and the driver 200 may be disposed between the refrigerant discharger 121 and the compression assembly 300.

Thus, when oil is stored on a bottom face of the casing 100, the oil may be supplied directly to the compression assembly 300 without passing through the driver 200. In addition, since the rotatable shaft 230 is coupled to and supported by the compression assembly 300, a lower frame for supporting the rotatable shaft may be omitted.

In one example, the lower scroll compressor 10 according to one embodiment of the present disclosure may be configured such that the rotatable shaft 230 penetrates not only the orbiting scroll 330 but also the fixed scroll 320 and is in face contact with both the orbiting scroll 330 and the fixed scroll 320.

As a result, an inflow force generated when the fluid such as the refrigerant is flowed into the compression assembly 300, a gas force generated when the refrigerant is compressed in the compression assembly 300, and a reaction force for supporting the same may be exerted on the rotatable shaft 230 at the same time. Accordingly, the inflow force, the gas force, and the reaction force may be concentrated on the rotatable shaft 230. As a result, since an upsetting moment may not act on the orbiting scroll 320 coupled to the rotatable shaft 230, tilting or upsetting of the orbiting scroll may be prevented. In other words, various tilting including tilting in an axial direction as occurring at the orbiting scroll 320 may be attenuated or prevented. As a result, noise and tilting generated at the lower scroll compressor 10 may be prevented.

In addition, in the lower scroll compressor 10 according to one embodiment of the present disclosure, a backpressure generated while the refrigerant is discharged to an outside of the compression assembly 300 is absorbed or supported by the rotatable shaft 230, so that a force (normal force) by which the orbiting scroll 330 and the fixed scroll 320 are in an excessively close contact state to each other in the axial direction may be reduced. As a result, a friction force between the orbiting scroll 330 and the fixed scroll 230 may be greatly reduced, such that durability of the compression assembly 300 may be improved.

In one example, the main frame 310 may include a main end plate 311 disposed on one side of the driver 200 or below the driver 300, a main side plate 312 extending from an inner face of the main end plate 311 in a direction farther away from the driver 200 and seated on the fixed scroll 330, and a main shaft receiving portion 318 extending from the main end plate 311 to rotatably support the rotatable shaft 230.

A main hole 317 for guiding the refrigerant discharged from the fixed scroll 320 to the refrigerant discharger 121 may be further defined in the main end plate 311 or the main side plate 312.

The main end plate 311 may further include an oil pocket 314 that is engraved in an outer face of the main shaft receiving portion 318. The oil pocket 314 may be defined in an annular shape, and may be defined to be eccentric to the main shaft receiving portion 318. When the oil stored in the sealing shell 130 is transferred through the rotatable shaft 230 or the like, the oil pocket 314 may be defined such that the oil is supplied to a portion where the fixed scroll 320 and the orbiting scroll 330 are engaged with each other.

The fixed scroll 320 may include a fixed end plate 321 coupled to the receiving shell 110 to form the other face of the compression assembly 300 while the main end plate 311 is disposed between the driver 300 and the fixed end plate 321, a fixed side plate 322 extending from the fixed end plate 321 toward the refrigerant discharger 121 and being in contact with the main side plate 312, and a fixed wrap 323 disposed on an inner circumferential face of the fixed side plate 322 to define the compression chamber in which the refrigerant is compressed.

Further, the fixed scroll 320 may include a fixed through-hole 328 defined to penetrate the rotatable shaft 230, and a fixed shaft receiving portion 3281 extending from the fixed through-hole 328 such that the rotatable shaft is rotatably supported. The fixed shaft receiving portion 3331 may be disposed at a center of the fixed end plate 321.

A thickness of the fixed end plate 321 may be equal to a thickness of the fixed shaft receiving portion 3381. In this case, the fixed shaft receiving portion 3281 may be inserted into the fixed through-hole 328 instead of protruding from the fixed end plate 321.

The fixed side plate 322 may include an inflow hole 325 defined therein for flowing the refrigerant into the fixed wrap 323, and the fixed end plate 321 may include discharge hole 326 defined therein through which the refrigerant is discharged. The discharge hole 326 may be defined in a center direction of the fixed wrap 323, or may be spaced apart from the fixed shaft receiving portion 3281 to avoid interference with the fixed shaft receiving portion 3281, or the discharge hole 326 may include a plurality of discharge holes.

The orbiting scroll 330 may include an orbiting end plate 331 disposed between the main frame 310 and the fixed scroll 320, and an orbiting wrap 333 disposed beneath the orbiting end plate to define the compression chamber together with the fixed wrap 323.

The orbiting scroll 330 may further include an orbiting through-hole 338 passing through the orbiting end plate 33. The rotatable shaft 230 is rotatably received in the orbiting through-hole 338.

In one example, the rotatable shaft 230 may be configured such that a portion thereof coupled to the orbiting through-hole 338 is eccentric. Thus, when the rotatable shaft 230 is rotated, the orbiting scroll 330 orbits in a state of being engaged with the fixed wrap 323 of the fixed scroll 320 to compress the refrigerant.

Specifically, the rotatable shaft 230 may include a main shaft 231 coupled to the driver 200 and rotating, and a bearing portion 232 connected to the main shaft 231 and rotatably coupled to the compression assembly 300. The bearing portion 232 may be included as a member separate from the main shaft 231, and may accommodate the main shaft 231 therein, or may be integrated with the main shaft 231.

The bearing portion 232 may include a main bearing portion 232*a* inserted into the main shaft receiving portion 318 of the main frame 310 and radially supported thereon, a fixed bearing portion 232*a* inserted into the fixed shaft receiving portion 3281 of the fixed scroll 320 and radially supported thereon, and an eccentric shaft 232*b* disposed between the main bearing portion 232*a* and the fixed bearing portion 232*a*, and inserted into the orbiting through-hole 338 of the orbiting scroll 330.

In this connection, the main bearing portion 232*a* and the fixed bearing portion 232*a* may be coaxial to have the same axis center, and the eccentric shaft 232*b* may be formed such that a center of gravity thereof is radially eccentric with respect to the main bearing portion 232*a* or the fixed bearing portion 232*a*. In addition, the eccentric shaft 232*b* may have an outer diameter greater than an outer diameter of the main bearing portion 232*a* or an outer diameter of the fixed bearing portion 232*a*. As such, the eccentric shaft 232*b* may provide a force to compress the refrigerant while orbiting the orbiting scroll 330 when the bearing portion 232 rotates, and the orbiting scroll 330 may be disposed to regularly orbit the fixed scroll 320 by the eccentric shaft 232*b*.

However, in order to prevent the orbiting scroll 320 from spinning, the lower scroll compressor 10 according to one embodiment of the present disclosure may further include an Oldham's ring 340 coupled to an upper portion of the orbiting scroll 320. The Oldham's ring 340 may be disposed between the orbiting scroll 330 and the main frame 310 to be in contact with both the orbiting scroll 330 and the main frame 310. The Oldham's ring 340 may be configured to linearly move in four directions of front, rear, left, and right directions to prevent the spinning of the orbiting scroll 320.

In one example, the rotatable shaft 230 may be disposed to completely pass through the fixed scroll 320 to protrude out of the compression assembly 300. As a result, the rotatable shaft 230 may be in direct contact with outside of the compression assembly 300 and the oil stored in the sealing shell 130. Thus, the rotatable shaft 230 may rotate to pull up the oil which in turn may be fed into the compression assembly 300.

An oil supply channel 234 for supplying the oil to an outer circumferential face of the main bearing portion 232*a*, an outer circumferential face of the fixed bearing portion 232*a*, and an outer circumferential face of the eccentric shaft 232*b* may be defined in an outer circumferential face of or inside the rotatable shaft 230.

In addition, a plurality of oil holes 234*a*, 234*b*, 234*c*, and 234*d* may be defined in the oil supply channel 234. Specifically, the oil hole may include a first oil hole 234*a*, a second oil hole 234*b*, a third oil hole 234*c*, and a fourth oil hole 234*d*. First, the first oil hole 234*a* may be defined to pass through the outer circumferential face of the main bearing portion 232*a*.

The first oil hole 234*a* may be defined to penetrate into the outer circumferential face of the main bearing portion 232*a* in the oil supply channel 234. In addition, the first oil hole 234*a* may be defined to penetrate, for example, an upper portion of the outer circumferential face of the main bearing portion 232*a*. However, the present disclosure is not limited thereto. That is, the first oil hole 234*a* may be defined to penetrate a lower portion of the outer circumferential face of the main bearing portion 232*a*. For reference, unlike as shown in the drawing, the first oil hole 234*a* may include a plurality of holes. In addition, when the first oil hole 234*a* includes the plurality of holes, the plurality of holes may be defined only in the upper portion or only in the lower portion of the outer circumferential face of the main bearing portion 232*a*, or may be defined in both the upper and lower portions of the outer circumferential face of the main bearing portion 232*a*.

In addition, the rotatable shaft 230 may include an oil feeder 233 disposed to pass through a muffler 500 to be described later to be in contact with the stored oil of the casing 100. The oil feeder 233 may include an extension shaft 233*a* passing through the muffler 500 and in contact with the oil, and a spiral groove 233*b* spirally defined in an outer circumferential face of the extension shaft 233*a* and in communication with the supply channel 234.

Thus, when the rotatable shaft 230 is rotated, due to the spiral groove 233*b*, a viscosity of the oil, and a pressure difference between a high pressure region S1 and an intermediate pressure region V1 inside the compression assembly 300, the oil rises through the oil feeder 233 and the supply channel 234 and is discharged into the plurality of oil holes. The oil discharged through the plurality of oil holes 234*a*, 234*b*, 234*c*, and 234*d* not only maintains an airtight state by forming an oil film between the fixed scroll 320 and the orbiting scroll 330, but also absorbs frictional heat generated at friction portions between the components of the compression assembly 300 and discharge the heat.

The oil guided along the rotatable shaft 230 and supplied through the first oil hole 234*a* may lubricate the main frame 310 and the rotatable shaft 230. In addition, the oil may be discharged through the second oil hole 234*b* and supplied to a top face of the orbiting scroll 330, and the oil supplied to the top face of the orbiting scroll 330 may be guided to the intermediate pressure region through the pocket groove 314. For reference, the oil discharged not only through the second oil hole 234*b* but also through the first oil hole 234*a* or the third oil hole 234*d* may be supplied to the pocket groove 314.

In one example, the oil guided along the rotatable shaft 230 may be supplied to the Oldham's ring 340 installed between the orbiting scroll 330 and the main frame 310 and to the fixed side plate 322 of the fixed scroll 320. Thus, wear of the fixed side plate 322 of the fixed scroll 320 and the Oldham's ring 340 may be reduced. In addition, the oil supplied to the third oil hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil supply structure in which the lower scroll compressor 10 uses the rotation of the rotatable shaft 230 to supply the oil to the bearing has been described, the centrifugal oil supply structure is merely an example. Further, a differential pressure supply structure for supplying oil using a pressure difference inside the compression assembly 300 and a forced oil supply structure for supplying oil through a trochoid pump, and the like may also be applied.

In one example, the compressed refrigerant is discharged to the discharge hole 326 along a space defined by the fixed wrap 323 and the orbiting wrap 333. The discharge hole 326 may be more advantageously disposed toward the refrigerant discharger 121. This is because the refrigerant discharged from the discharge hole 326 is most advantageously delivered to the refrigerant discharger 121 without a large change in a flow direction.

However, because of the structural characteristics that the driver 200 should be disposed between the compression assembly 300 and the refrigerant discharger 121, and that the fixed scroll 320 should constitute an outermost portion of the compression assembly 300, the discharge hole 326 is defined to spray the refrigerant in a direction opposite to a direction toward the refrigerant discharger 121.

In other words, the discharge hole 326 is defined to spray the refrigerant in a direction away from the refrigerant discharger 121 with respect to the fixed end plate 321. Therefore, when the refrigerant is sprayed into the discharge hole 326 as it is, the refrigerant may not be smoothly discharged to the refrigerant discharger 121, and when the oil is stored in the sealing shell 130, the refrigerant may collide with the oil and be cooled or mixed.

In order to prevent this situation, the compressor 10 according to one embodiment of the present disclosure may further include a muffler 500 coupled to an outermost portion of the fixed scroll 320 and providing a space for guiding the refrigerant to the refrigerant discharger 121.

The muffler 500 may be disposed to seal one face disposed in a direction farther away from the refrigerant discharger 121 of the fixed scroll 320 to guide the refrigerant discharged from the fixed scroll 320 to the refrigerant discharger 121.

The muffler 500 may include a coupling body 520 coupled to the fixed scroll 320 and a receiving body 510 extending from the coupling body 520 to define sealed space therein. Thus, the refrigerant sprayed from the discharge hole 326 may be discharged to the refrigerant discharger 121 by switching the flow direction along the sealed space defined by the muffler 500.

Further, since the fixed scroll 320 is coupled to the receiving shell 110, the refrigerant may be restricted from flowing to the refrigerant discharger 121 by being interrupted by the fixed scroll 320. Therefore, the fixed scroll 320 may further include a bypass hole 327 defined therein allowing the refrigerant penetrated the fixed end plate 321 to pass through the fixed scroll 320. The bypass hole 327 may be disposed to be in communication with the main hole 331*a*. Thus, the refrigerant may pass through the compression assembly 300, pass the driver 200, and be discharged to the refrigerant discharger 121.

Further, as the refrigerant flows more inwardly from an outer circumferential face of the fixed wrap 323, the refrigerant is compressed to have a higher pressure. Thus, an interior of the fixed wrap 323 and an interior of the orbiting wrap 333 is maintained in a high pressure state. Accordingly, a discharge pressure is exerted to a rear face of the orbiting scroll as it is. Thus, in a reaction manner thereto, the backpressure is exerted from the orbiting scroll 330 toward the fixed scroll 320. The compressor 10 according to one embodiment of the present disclosure may further include a backpressure seal 350 that concentrates the backpressure on a portion where the orbiting scroll 320 and the rotatable shaft 230 are coupled to each other, thereby preventing leakage between the orbiting wrap 333 and the fixed wrap 323.

The backpressure seal 350 is disposed in a ring shape to maintain an inner circumferential face thereof at a high pressure, and separate an outer circumferential face thereof at an intermediate pressure lower than the high pressure. Therefore, the backpressure is concentrated on the inner circumferential face of the backpressure seal 350, so that the orbiting scroll 330 is in close contact with the fixed scroll 320.

In this connection, when considering that the discharge hole 326 is defined to be spaced apart from the rotatable shaft 230, the backpressure seal 350 may be configured such that a center thereof is biased toward the discharge hole 326.

In one example, the oil supplied to the compression assembly 300, or the oil stored in the oil storage space P of the casing 100 may flow toward an upper portion of the casing 100 together with the refrigerant as the refrigerant is discharged to the refrigerant discharger 121. In this connection, because the oil is denser than the refrigerant, the oil may not be able to flow to the refrigerant discharger 121 by a centrifugal force generated by the rotor 220, and may be attached to inner walls of the discharge shell 110 and the receiving shell 120. The lower scroll compressor 10 according to one embodiment of the present disclosure may further include collection passages F respectively on outer circumferential faces of the driver 200 and the compression assembly 300 to collect the oil attached to an inner wall of the casing 100 to the oil storage space of the casing 100 or the sealing shell 130.

The collection channel may include a driver collection channel 201 defined in an outer circumferential face of the driver 200, a compression assembly collection channel 301 defined in an outer circumferential face of the compression assembly 300, and a muffler collection channel 501 defined in an outer circumferential face of the muffler 500.

The driver collection channel 201 may be defined by recessing a portion of an outer circumferential face of the stator 210 is recessed, and the compression assembly collection channel 301 may be defined by recessing a portion of an outer circumferential face of the fixed scroll 320. In addition, the muffler collection channel 501 may be defined by recessing a portion of the outer circumferential face of the muffler. The driver collection channel 201, the compression assembly collection channel 301, and the muffler collection channel 501 may be defined in communication with each other to allow the oil to pass therethrough.

Further, because the rotatable shaft 230 has a center of gravity biased to one side due to the eccentric shaft 232*b*, during the rotation, an unbalanced eccentric moment occurs, causing an overall balance to be distorted. Accordingly, the lower scroll compressor 10 according to one embodiment of the present disclosure may further include a balancer 400 that may offset the eccentric moment that may occur due to the eccentric shaft 232*b*.

Further, because the compression assembly 300 is fixed to the casing 100, the balancer 400 is preferably coupled to the rotatable shaft 230 itself or the rotor 220 disposed to rotate. Therefore, the balancer 400 may include a central balancer 420 disposed on a bottom of the rotor 220 or on a face facing the compression assembly 300 to offset or reduce an eccentric load of the eccentric shaft 232*b*, and an outer balancer 410 coupled to a top of the rotor 220 or the other face facing the refrigerant discharger 121 to offset an eccentric load or an eccentric moment of at least one of the eccentric shaft 232*b* and the central balancer 420.

Because the central balancer 420 is disposed relatively close to the eccentric shaft 232*b*, the central balancer 420 may directly offset the eccentric load of the eccentric shaft 232*b*. Accordingly, the central balancer 420 is preferably disposed eccentrically in a direction opposite to the direction in which the eccentric shaft 232*b* is eccentric. As a result, even when the rotatable shaft 230 rotates at a low speed or a high speed, because a spacing away from the eccentric shaft 232*b* is close, the central balancer 420 may effectively offset an eccentric force or the eccentric load generated in the eccentric shaft 232*b* almost uniformly.

The outer balancer 410 may be disposed eccentrically in a direction opposite to the direction in which the eccentric shaft 232*b* is eccentric. However, the outer balancer 410 may be eccentrically disposed in a direction corresponding to the eccentric shaft 232*b* to partially offset the eccentric load generated by the central balancer 420.

As a result, the central balancer 420 and the outer balancer 410 may offset the eccentric moment generated by the eccentric shaft 232*b* to assist the rotatable shaft 230 to rotate stably.

Further, referring to FIG. 1, a plurality of discharge holes 326 may be defined.

Generally, in the scroll compressor, the fixed wrap 323 and the orbiting wrap 333 extend radially around the center of the fixed scroll 320 as in a logarithmic spiral or involute shape. Therefore, since the center of the fixed scroll 320 has the highest pressure, it is common to define a discharge hole 326 in the center thereof.

However, in the lower scroll compressor 10 according to one embodiment of the present disclosure, since the rotatable shaft 230 passes through the fixed end plate 321 of the fixed scroll 320, the discharge hole 326 cannot be located in the center of the wrap. Therefore, the compressor 10 according to one embodiment of the present disclosure may include discharge holes 326*a* and 326*b* defined in the inner circumferential face and the outer circumferential face of the center of the orbiting wrap, respectively (See FIGS. 2A to 2C).

Furthermore, during low-load operation such as partial load, overcompression of the refrigerant may occur in the space having the discharge hole 326, thereby reducing efficiency. Therefore, unlike shown in the drawing, a plurality of discharge holes may be further defined in and along the inner circumferential face or the outer circumferential face of the orbiting wrap (Multi-step discharge scheme).

Hereinafter, with reference to FIGS. 2A to 2C, an operating aspect of the lower scroll compressor 10 according to one embodiment of the present disclosure will be described.

FIG. 2A illustrates the orbiting scroll, FIG. 2B illustrates the fixed scroll, and FIG. 2C illustrates a process in which the orbiting scroll and the fixed scroll type compress the refrigerant.

The orbiting scroll 330 may include the orbiting wrap 333 on one face of the orbiting end plate 331, and the fixed scroll 320 may include the fixed wrap 323 on one face of the fixed end plate 321 facing toward the orbiting scroll 330.

In addition, the orbiting scroll 330 is embodied as a sealed rigid body to prevent the refrigerant from being discharged to the outside. However, the fixed scroll 320 may include the inflow hole 325 in communication with a refrigerant supply pipe such that the refrigerant at a low temperature and a low pressure may inflow, and the discharge hole 326 through which the refrigerant of a high temperature and a high pressure is discharged. Further, a bypass hole 327 through which the refrigerant discharged from the discharge hole 326 is discharged may be defined in an outer circumferential face of the fixed scroll 320.

The fixed wrap 323 and the orbiting wrap 333 may be configured to extend radially from an outer face of the fixed shaft receiving portion 3281. Therefore, a radius of each of the fixed wrap 323 and the orbiting wrap 333 according to one embodiment of the present disclosure may be relatively larger than that in the conventional scroll compressor. As a result, when the fixed wrap 323 and the orbiting wrap 333 are conventionally embodied in a logarithmic spiral or involute shape, a curvature decreases and thus a compression ratio decreases. Further, a strength of each of the fixed wrap 323 and the orbiting wrap 333 is weakened such that there is a risk of deformation.

Accordingly, in the compressor 10 according to one embodiment of the present disclosure, the fixed wrap 323 and the orbiting wrap 333 may have a shape of a combination of a plurality of arcs whose curvatures continuously vary. For example, each of the fixed wrap 323 and the orbiting wrap 333 may be embodied as a hybrid wrap having a shape of a combination of at least 20 arcs whose curvatures continuously vary.

Further, in the lower scroll compressor 10 according to one embodiment of the present disclosure, the rotatable shaft 230 is configured to penetrate the fixed scroll 320 and the orbiting scroll 330, such that a radius of curvature and a compression space of each of the fixed wrap 323 and orbiting wrap 333 are reduced.

Therefore, in order to compensate for this reduction, the compressor 10 according to one embodiment of the present disclosure, the radius of curvature of each of the fixed wrap 323 and the orbiting wrap 333 at a portion thereof immediately before a discharge point may be smaller than that of the shaft receiving portion of the rotatable shaft such that the space to which the refrigerant is discharged may be reduced and a compression ratio may be improved. That is, each of the fixed wrap 323 and the orbiting wrap 333 may be configured to have the radius of curvature varying based on a position such that the radius of curvature thereof at the vicinity of the discharge hole 326 is the smallest and then the radius of curvature thereof gradually increases toward the inflow hole 325.

Referring to FIG. 2C, refrigerant I is flowed into the inflow hole 325 of the fixed scroll 320, and refrigerant II flowed before the refrigerant I flows is located near the discharge hole 326 of the fixed scroll 320.

In this connection, the refrigerant I is present in a region on outer circumferential faces of the fixed wrap 323 and the orbiting wrap 333 where the fixed wrap 323 and the orbiting wrap 333 are engaged with each other, and the refrigerant II is present in a sealed manner in another region in which the fixed wrap 323 and the orbiting wrap 333 are engaged with each other at two contact points.

Thereafter, when the orbiting scroll 330 starts to orbit, as the region in which the fixed wrap 323 and the orbiting wrap 333 are engaged with each other at two contact points is displaced along an extension direction of the orbiting wrap 333 and the orbiting wrap 333, such that a volume of the region begins to be reduced. Thus, the refrigerant I starts to flow and be compressed. The refrigerant II starts to be further reduced in volume, be compressed, and guided to the discharge hole 326.

The refrigerant II is discharged from the discharge hole 326. As the region in which the fixed wrap 323 and the orbiting wrap 333 are engaged with each other at two contact points is displaced in a clockwise direction, the refrigerant I flows, and the volume of the refrigerant I starts to decrease such that refrigerant I is further compressed.

As the region in which the fixed wrap 323 and the orbiting wrap 333 are engaged with each other at two contact points is displaced again in the clockwise direction and thus is closer to an interior of the fixed scroll, the volume of the refrigerant I further decreases and the discharge of the refrigerant II is substantially completed.

As such, as the orbiting scroll 330 orbits, the refrigerant may be compressed linearly or continuously while flowing into the fixed scroll.

Although the drawing shows that the refrigerant flows into the inflow hole 325 discontinuously, this is intended only for illustrative purpose. Alternatively, the refrigerant may be supplied thereto continuously. Further, the refrigerant may be accommodated and compressed in each of regions where the fixed wrap 323 and the orbiting wrap 333 are engaged with each other at two contact points.

As described above, the Oldham's ring 340 prevents spinning of the orbiting scroll 330. More specifically, when the rotatable shaft 230 rotates, the orbiting scroll 330 rotates. Thus, the Oldham's ring 340 may change the rotation of the orbiting scroll 330 into four directions (front, rear, left and right) to prevent spinning of the orbiting scroll 330. Therefore, the impact force or stress generated in the process of changing the rotation of the orbiting scroll 330 into the four directions acts on the Oldham's ring 340.

Figure 3:
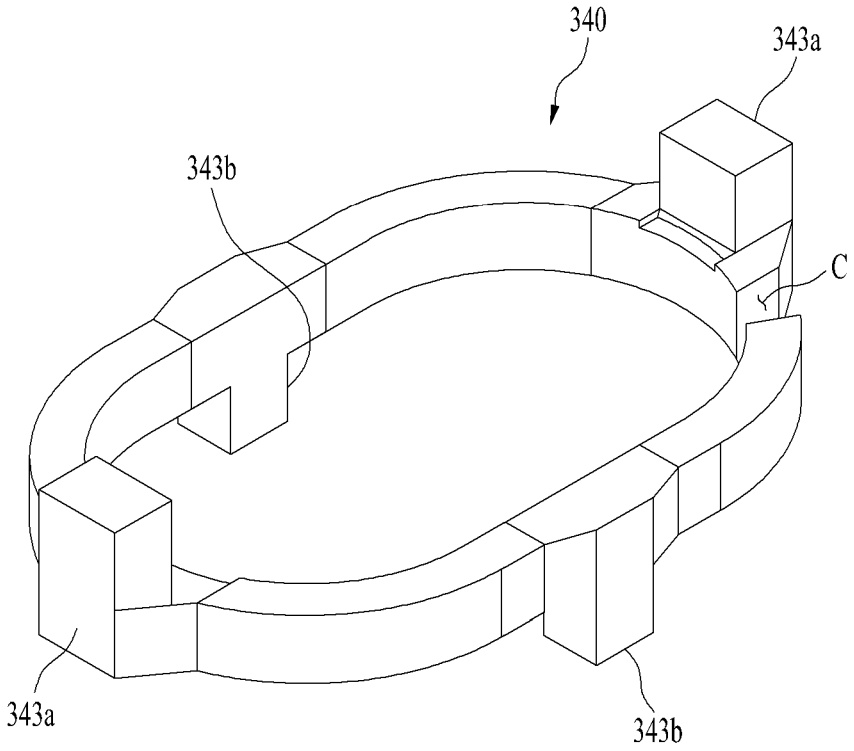
FIG. 3 is a diagram showing a portion of the Oldham's ring on which an impact force is concentrated.

FIG. 3 is a diagram showing a portion of the Oldham's ring on which the impact force is concentrated.

Hereinafter, with reference to FIG. 3, a region of the Oldham's ring 340 where the impact force or stress generated in the Oldham's ring 340 is concentrated will be described.

The Oldham's ring 340 includes a ring body 341 disposed between the orbiting scroll 330 and the main frame 310, and a plurality of keys 343 protruding from the ring body 341 and coupled to the orbiting scroll 330 and the main frame 310.

That is, the key 343 includes main keys 343*a* coupled to the main frame 310 and orbiting keys 343*b* coupled to the orbiting scroll 330. Each main key 343*a* may protrude from the ring body 341 in a direction away from the orbiting scroll 330. Each orbiting key 343*b* may protrude from the ring body 341 in a direction away from the main frame 310.

A stress concentrated position C may be disposed between each key 343 and the ring body 341. Further, the stress generated in the stress concentrated position C may be caused due to transmission thereto of an impact force generated between a key groove as described later and the key 343.

Therefore, in order to reduce the stress generated in the stress concentrated position C, it is necessary to reduce the impact force generated between the key 343 and the key groove which will be described later.

In one embodiment of the present disclosure, a deformable groove 600 may be defined in order to reduce the impact force occurring between the key 343 and the key groove to be described later.

Figure 4:
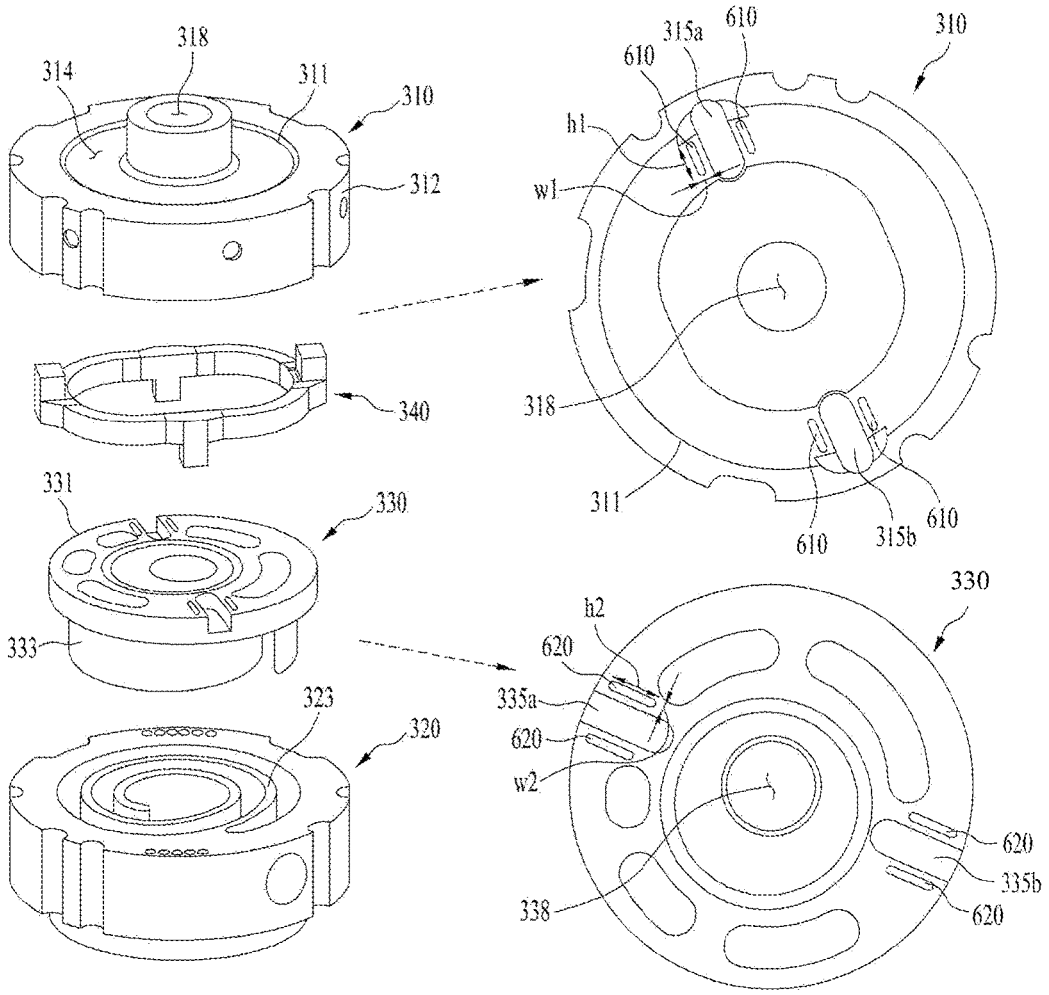
FIG. 4 is a diagram showing a deformable groove according to one embodiment of the present disclosure.

FIG. 4 is a diagram showing a deformable groove according to one embodiment of the present disclosure.

Hereinafter, referring to FIG. 4, a general shape and a location of the deformable groove 600 will be described.

The deformable groove 600 may include a main deformable groove 610 formed in the main frame 310 and an orbiting deformable groove 620 formed in the orbiting scroll 330.

The main frame 310 and the orbiting scroll 330 may respectively include a plurality of key grooves 315 and 335 recessed toward the rotatable shaft 230 so that each key 343 may be inserted into each key groove. That is, the key grooves may include a main key groove 315 which is recessed in the main frame 310 in a direction away from the orbiting scroll 330, and an orbiting key groove 335 recessed in the orbiting scroll 330 in a direction away from the main frame 310.

The main key groove 315 may include a first main key groove 315*a* and a second main key groove 315*b* symmetrically arranged with respect to the main shaft receiving portion 318. In other words, the second main key groove 315*b* may be located at an extension of an axis line extending between a center of the first main key groove 315*a* and the main shaft receiving portion 318.

The main deformable groove 610 is formed to extend parallel to the main key groove 315, and may be formed to be depressed in the main frame 310. That is, the main deformable groove 610 may be recessed in one face of the main frame facing toward the driver 200 and in a direction away from the driver 200 and may extend parallel to the main key groove 315.

Further, the main deformable groove 610 may have a length h1 in a direction parallel to a length direction of the main key groove 315, and a width w1 in a direction perpendicular to a length direction of the main key groove 315.

As will be described later in FIGS. 5A to 5C, the smaller the width w1 is, the smaller the impact force generated between the key groove 315 and the key 343 may be. Thus, the width w1 is preferably smaller than the length h1.

The above description is about the main key groove 315 and the main deformable groove 610 formed in the main frame 310, but may be equally applied to the orbiting scroll 330.

That is, the orbiting scroll 330 may include a plurality of orbiting key grooves 335*a* and 335*b* that are recessed in the orbiting scroll 330 and in a direction away from the main frame 310. Further, the orbiting deformable groove 620 may have a length h2 in a direction parallel to a length direction of the orbiting key groove 335, and a width w2 in a direction perpendicular to a length direction of the orbiting key groove 335. In addition, the length h2 of the orbiting deformable groove 620 is preferably larger than the width w2 thereof.

Hereinafter, referring to FIGS. 5A to 5C, a principle of reducing the impact force generated in the Oldham's ring 340 using the deformable groove 600 and an impact-force dissipating member capable of further reducing the impact force will be described.

Figure 5A:
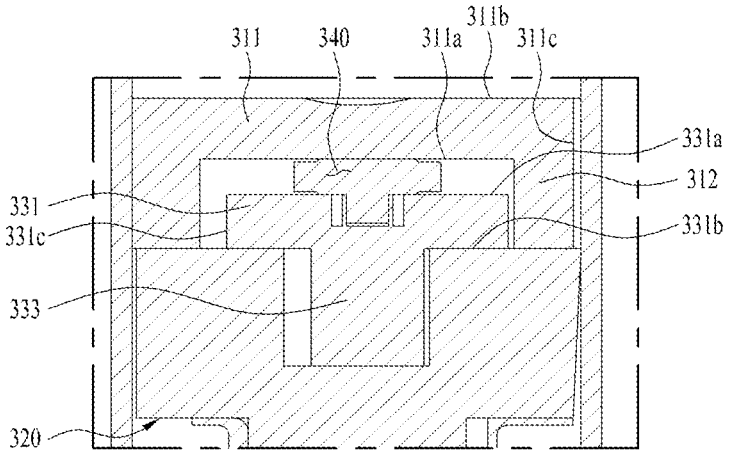
FIGS. 5A to 5C are diagrams showing a principle of reducing the impact force using the deformable groove and an impact-force dissipating member according to one embodiment of the present disclosure.

FIG. 5A is a diagram showing the compression assembly 300. FIG. 5B is an enlarged view of a portion where the Oldham's ring 340 and the orbiting scroll 330 contact each other to describe the deformable groove 600. FIG. 5C is an enlarged view of a portion where the Oldham's ring 340 and the orbiting scroll 330 contact each other to describe the impact-force dissipating member 630.

Figure 5B:
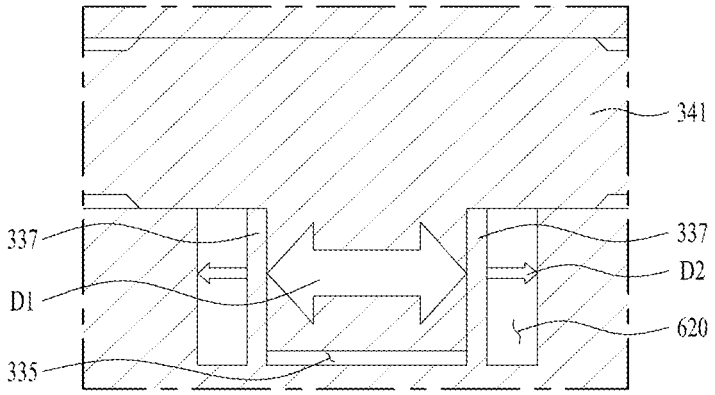

Referring to FIG. 5B, the orbiting deformable groove 620 may be deformed based on behavior of the Oldham's ring 340.

When the rotatable shaft 230 rotates, the orbiting scroll 330 coupled to the rotatable shaft 230 rotates. The orbiting scroll 330 may be prevented from spinning while contacting the Oldham's ring 340. More specifically, the orbiting key 343*b* may contact a sidewall of the orbiting key groove 335 such that the orbiting key 343*b* is prevented from escaping from the orbiting key groove 335.

Therefore, a partition wall 337 located between the orbiting key groove 335 and the orbiting deformable groove 620 will be deformed due to a force by which the orbiting key 343*b* escapes from the orbiting key groove 335 while the orbiting key 343*b* contacts the sidewall of the orbiting key groove 335. That is, the partition wall 337 may be deformed in the same direction as a direction D1 in which the orbiting key 343*b* moves inside the orbiting key groove 335.

In this case, as the partition wall 337 is deformed, the impact force generated between the orbiting key groove 335 and the orbiting key 343*b* may be reduced. In other words, when the orbiting key 343*b* applies an impact force to the orbiting key groove 335 in a circumferential direction thereof, the partition wall 337 may be deformed as much as the impact force is transmitted thereto.

As described above, as the partition wall 337 is deformed, the impact force generated between the orbiting key groove 335 and the orbiting key 343*b* may be reduced. Therefore, it is preferable that the partition wall 337 is configured to be easily deformed.

Figure 5C:
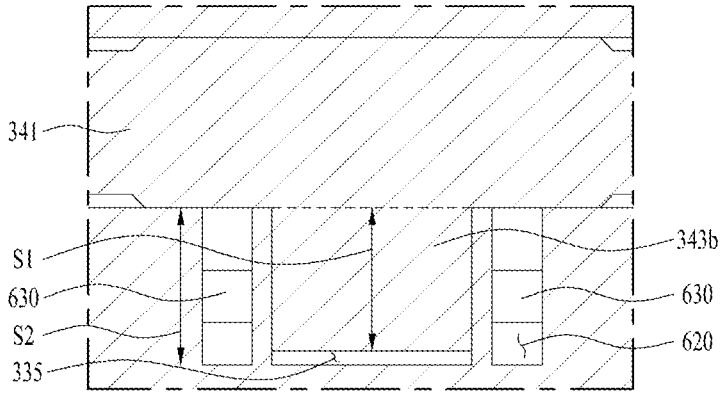

Referring to FIG. 5C, it is preferable that a depression S2 of the orbiting deformable groove 620 is greater than a depression S1 of the orbiting key groove 335. More specifically, the orbiting key groove 335 may be recessed in a direction away from the ring body 341 or in an axial direction to define a predefined depth S1. Further, the orbiting deformable groove 620 may be depressed in a direction away from the ring body 341 or in an axial direction to define a predefined depth S2.

In this connection, when the depth S2 of the orbiting deformable groove 620 is larger than the depth S1 of the orbiting key groove 335, the partition wall 337 may be more easily deformed. This is because, in order for the impact force generated between the orbiting key groove 335 and the orbiting key 343*b* to be transferred to the partition wall 337 to cause the partition wall 337 to be deformed, the orbiting deformable groove 620 which helps the partition wall 337 deform must have the sufficient depth S2.

If the depth S2 of the orbiting deformable groove 620 is smaller than the depth S1 of the orbiting key groove 335, the impact force generated between the orbiting key groove 335 and the orbiting key 343*b* is converted to a stress in a region of the orbiting end plate 311 located under the orbiting deformable groove 620, thereby to prevent the partition wall 337 to be deformed.

In another example, in order to secure reliability of the orbiting end plate 331 even when the partition wall 337 is deformed, the orbiting deformable groove 620 may preferably extend to be spaced apart from a side face of the orbiting end plate 331.

More specifically, referring to FIG. 5A, the orbiting end plate 331 may include one face 331*a* facing the main frame 310, an opposite face 331*b* spaced apart from one face 331*a* and seated on the fixed scroll 320, and an outer side face 331*c* extending between one face 331*a* and the opposite face 331*b*.

The orbiting deformable groove 620 may be recessed in one face 331*a* toward the opposite face 331*b* and may have a width in a direction toward the outer side face 331*c*, and may be spaced apart from the outer side face 331*c* to promote the reliability of the orbiting end plate 331.

Further, when taking into account that the partition wall 337 has an elastic deformation limit, the impact-force dissipating member 630 that is deformed according to the deformation of the orbiting deformable groove 620 and the partition wall 337 may be located in the orbiting deformable groove 620.

A width of the impact-force dissipating member 630 may be equal to or larger than the width w2 of the orbiting deformable groove 620 and may be press-fitted to the orbiting deformable groove 620 and may be made of a material that absorbs the impact force and tilting inside the orbiting deformable groove 620. For example, the impact-force dissipating member 630 may be made of a polymer material, and may be made of rubber.

Therefore, even when the partition wall 337 is deformed within the limit of elastic deformation, the impact-force dissipating member 630 is deformed in the same direction as the deformation direction of the partition wall 337, thereby further reducing the impact force.

The above description is only about the orbiting deformable groove 620 formed in the orbiting scroll 330, and may be equally applied to the main deformable groove 610 formed in the main frame 310.

That is, the main end plate 311 may include one face 311*a* in contact with the ring body 341, an opposite face 311*b* spaced from one face 311*a* in a direction away from the ring body 341, and an outer side face 311*c* extending between one face 311*a* and the opposite face 311*b*.

The main deformable groove 610 which is depressed in one face 311*a* toward the opposite face 311*b*, and has a width in a direction toward the outer side face 311*c* may be spaced apart from the outer side face 311*c*. A depression of the main deformable groove 610 toward the opposite face 311*b* may be greater than a depression of the main key groove 315 toward the opposite face 311*b*.

Further, in the main end plate 311, the partition wall 317 may be formed, which is located between the main key groove 315 and the main deformable groove 610 and deforms due to the impact force. The impact-force dissipating member 630 is located inside the main deformable groove 610, so that the impact force may be more efficiently reduced.

In this way, when the main deformable groove 610 and the orbiting deformable groove 620 are defined, the impact force generated in the Oldham's ring 340 may be effectively reduced although a separate component is not installed in order to reduce the impact force generated in the Oldham's ring 340.

Further, even when the partition walls 317 and 337 deform within the elastic deformation limit, the impact-force dissipating members 630 other than the partition walls 317 and 337 may reduce the impact force by a larger amount by which the impact force may be reduced when using only the partition walls 317 and 337.

Further, the stress generated in the ring body 341 is reduced, so that the reliability of the Oldham's ring 340 may be improved, and the tilting and noise generated in an entirety of the compressor 10 may be reduced.

Hereinafter, various shapes of the deformable groove 600 according to one embodiment of the present disclosure will be described with reference to FIGS. 6A to 6C.

Figure 6A:
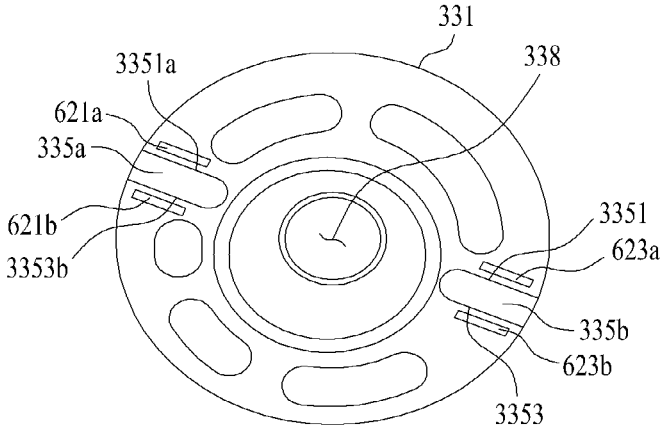
FIGS. 6A to 6C are diagrams showing an embodiment in which a shape of the deformable groove according to the present disclosure is changed.

Referring to FIG. 6A, the orbiting deformable groove 620 may include a pair of orbiting deformable grooves 621*a* and 621*b* on both sides of the orbiting key groove 335 interposed therebetween.

More specifically, the orbiting key groove 335 may include a first orbiting key groove 335*a* and a second orbiting key groove 335*b* while the orbiting shaft receiving portion 338 is interposed therebetween.

The first orbiting key groove 335*a* may include a first face 3351*a* having a planar shape, a second face 3353*a* spaced apart from the first face 3351*a* and parallel to the first face 3351*a*, and a connection face as a curved face extending between the first face 3315*a* and the second face 3351*a*.

The first orbiting deformable groove 621*a* may be spaced apart from the first face 3351*a* and extend parallel to a length direction of the first orbiting key groove 335*a* and may have a width in a direction away from the second face 3353*a*. The second orbiting deformable groove 621*b* may be spaced apart from the second face 3353*a* and extend parallel to a length direction of the first orbiting key groove 335*a* and may have a width in a direction away from the first face 3351*a*.

That is, the first orbiting key groove 335*a* may be defined between the first orbiting deformable groove 621*a* and the second orbiting deformable groove 621*b*. The first orbiting deformable groove 621*a* and the second orbiting deformable groove 621*b* may extend in parallel with each other.

Further, the second orbiting key groove 335*b* may include a first face 3351*b*, a second face 3353*b*, and a connection face in the same manner as in the first orbiting key groove 335*a*. A third orbiting deformable groove 623*a* and a fourth orbiting deformable groove 623*b* may be defined in the orbiting end plate 331 and may be spaced apart from the second orbiting key groove 335*b* while the second orbiting key groove 335*b* is interposed therebetween.

Further, in the same way in which the plurality of the orbiting deformable groove 621*a*, 621*b*, 623*a*, and 623*b* are defined in the orbiting end plate 331, a plurality of the main deformable grooves 611*a*, 611*b*, 613*a*, and 613*b* may be defined in the main end plate 311.

That is, the first main key groove 315*a* may be defined between the first main deformable groove 611*a* and the second main deformable groove 611*b* extending in parallel with each other.

The second main key groove 315*b* may be defined between the third main deformable groove 613*a* and the fourth main deformable groove 63*b* extending parallel to each other.

Further, each of the first main key groove 315*a* and the second main key groove 315*b* may have a first face 3151 having a planar shape, a second face 3153 spaced apart from the first face 3151 and extending in parallel to the first face 3151, and a connection face as a curved face extending between the first face 3151 and the second face 3153.

Therefore, when considering that the impact force is not generated only on one side of each of the key grooves 315 and 335 as the rotatable shaft 230 rotates, the deformable groove 600 may be defined on each of both sides of each of the key grooves 315 and 335, so that the impact force generated on both sides of each of the key grooves 315 and 335 may be reduced.

Figure 6B:
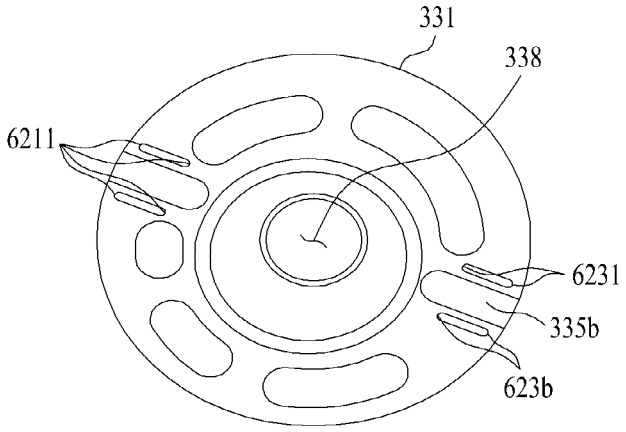

Referring to FIG. 6B, the first orbiting deformable groove to the fourth orbiting deformable groove 621*a*, 621*b*, 623*a*, and 623*b* may have curved faces 6211 and 6231 that allow the partition wall 337 to be easily deformed.

More specifically, each of the curved faces 6211 and 6231 may define at least one of both length-directional ends of each of the orbiting deformable grooves 620. That is, each of the curved faces 6211 and 6231 may define one length-directional end of each of the first orbiting deformable groove to the fourth orbiting deformable groove 621*a*, 621*b*, 623*a*, and 623*b* closer to the outer side face 331*c* of the orbiting end plate 311. Alternatively, each of the curved faces 6211 and 6231 may define one length-directional end of each of the first orbiting deformable groove to the fourth orbiting deformable groove 621*a*, 621*b*, 623*a*, and 623*b* far away from the outer side face 331*c* of the orbiting end plate 311.

The above description is about the curved faces 6211 and 6231 formed in the orbiting end plate 331, but may be equally applied to the main end plate 311.

That is, each of the curved faces 6111 and 6131 may define at least one of both end portions in an extension direction of each of the first main deformable groove to the fourth main deformable groove 611*a*, 611*b*, 613*a*, and 613*b*.

In this case, the curved faces 6111, 6131, 6211, and 6231 may play a role of allowing easy deformation of the partition walls 317 and 337 due to the impact force transmitted to the partition walls 317 and 337. That is, the curved faces 6111, 6131, 6211, and 6231 may apply a stronger elastic restoring force to the deformable groove 600, so that even though each of the partition walls 317 and 337 is deformed in the same amount, the impact force may be reduced by a larger amount.

Figure 6C:
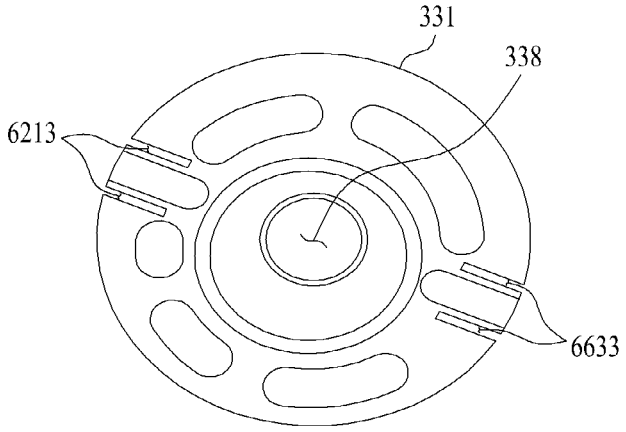

Referring to FIG. 6C, each of the first orbiting deformable groove 621*a* and the second orbiting deformable groove

621*b* may have an extension 6213 extending toward the outer side face 331*c* of the orbiting end plate 311 and passing through the outer side face 331*c*.

Unlike the foregoing configuration of FIG. 5C, when each of the first orbiting deformable groove 621*a* and the second orbiting deformable groove 621*b* further include the extension 6213 passing through the outer side face 331*c*, a component of the impact force acting at a position near the outer side face 331*c* of the orbiting end plate 331 among components of the impact force acting on the partition wall 337 may be more efficiently reduced. This is because the extension 6213 induces deformation of the partition wall 337 outwardly in the radial direction.

Further, the aforementioned extension 6213 is defined in each of the first orbiting deformable groove 621*a* and the second orbiting deformable groove 621*b*. An extension 6233 as the same configuration as that of the aforementioned extension 6213 may be defined in each of the third orbiting deformable groove 623*a* and the third orbiting deformable groove 623*b*.

When considering that the main end plate 311 is coupled to the inner circumferential face of the casing 100, it may be desirable that no extension is defined in the main end plate 311. This is because when the extension passes through the outer side face 331*c* of the main end plate 311, the extension may interfere with the oil collection flow F or may interfere with the refrigerant channel.

As the rotatable shaft 230 rotates eccentrically, a contact point between each of the key grooves 315 and 335 and the key 343 may vary. That is, when the rotatable shaft 230 rotates eccentrically, the key 343 may be temporarily biased inside each of the key grooves 315 and 335 such that the key 343 and each of the key grooves 315 and 335 may be separated from each other.

In this case, the impact force does not occur in a position in which each of the key grooves 315 and 335 is separated from the key 343, while the impact force may be concentrated on a position in which each of the key grooves 315 and 335 is in contact with the key 343.

That is, each of the key grooves 315 and 335 may have each of contact points 3155 and 3355 on which the impact force is concentrated according to eccentric rotation of the rotatable shaft 230.

Figure 7:
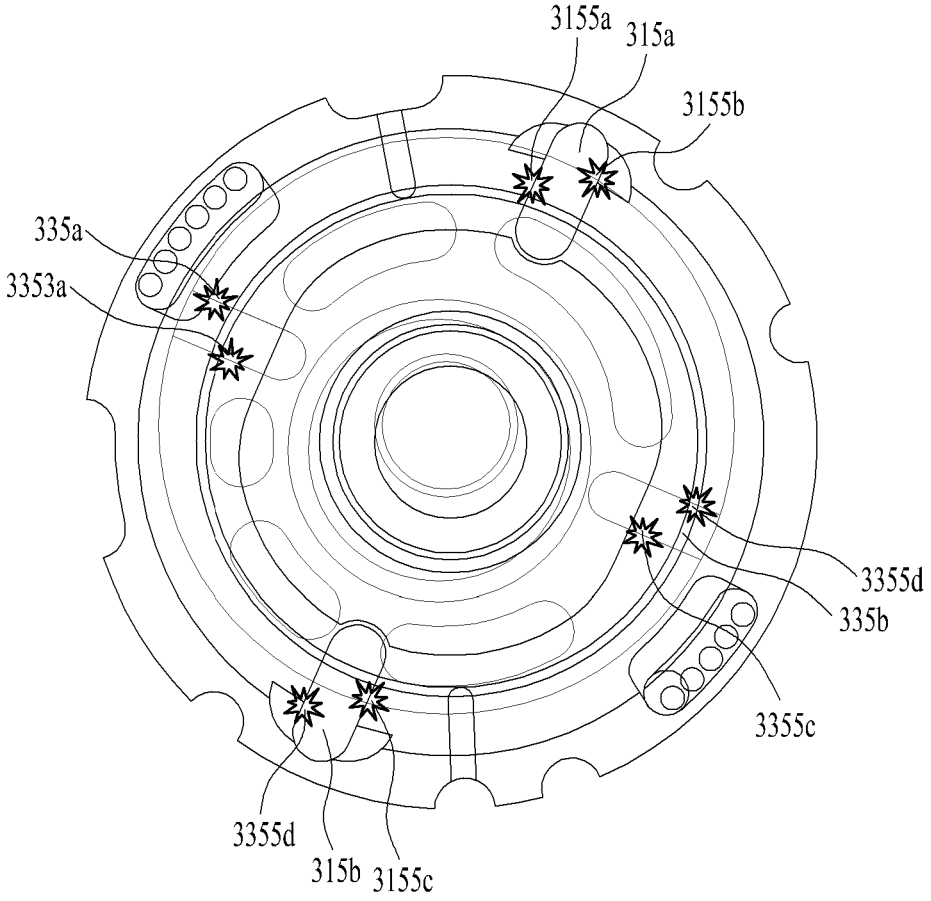
FIG. 7 is a diagram showing a portion where the impact force generated in the Oldham's ring is intensively transmitted to a key groove.

Hereinafter, the contact points 3155 and 3355 of the key grooves 315 and 335 will be described with reference to FIG. 7

The contact point may include a main contact point occurring between the main key groove 315 and the key 343.

The main contact point may include a first main contact point 3155*a* and a second main contact point 3155*b* occurring on the first main key groove 315*a*.

The first main contact point 3155*a* and the second main contact point 3155*b* may be arranged in a non-symmetrical to each other. That is, a spacing between the first main contact point 3155*a* and the outer side face 331*c* may be different from a spacing between the second main contact point 3155*b* and the outer side face 331*c*.

Similarly, the main contact point may include a third main contact point 3155*c* and a fourth main contact point 3155*d* occurring on the second main key groove 315*b*.

Further, the contact point may include an orbiting contact point occurring between the orbiting key groove 335 and the key 343. The orbiting contact point may include a first orbiting contact point 3355*a* and a second orbiting contact point 3355*b* occurring on the first orbiting key groove 335*a*.

A spacing between the first orbiting contact point 3355*a* and the outer side face 331*c* may be different from a spacing between the second orbiting contact point 3355*b* and the outer side face 331*c*. In this connection, the spacing from the outer side face 331*c* may refer to a spacing in the extending direction of the deformable groove 600.

Similarly, the orbiting contact point may include a third orbiting contact point 3355*c* and a fourth orbiting contact point 3355*d* occurring on the second orbiting key groove 335*b*.

In this case, positions of the partition walls 317 and 337 at which the partition walls 317 and 337 are deformed may vary depending on positions of the contact points 3155 and 3355. That is, when the position on the deformable groove 600 corresponding to a position of each of the contact points 3155 and 3355 is located at a center of the length of the deformable groove 600, the impact force transmitted to each of the contact points 3155 and 3355 may deform each of the partition walls 317 and 337 by a larger amount. To the contrary, when the position of the deformable groove 600 corresponding to a position of each of the contact points 3155 and 3355 is located at a position deviated from the center of the deformable groove 600, the impact force transmitted to each of the contact points 3155 and 3355 may deform each of the partition walls 317 and 337 by a smaller amount.

Therefore, the deformable groove 600 is preferably formed in consideration of the positions of the contact points 3155 and 3355.

Hereinafter, the deformable groove 600 according to one embodiment of the present disclosure as defined while taking into account the positions of the contact points 3155 and 3355 will be described with reference to FIG. 8A to FIG. 9B FIGS. 8A and 8B are diagrams showing a positional correspondence between the impact-force dissipating member 630 and each of the contact points 3155 and 3355.

Figure 8A:
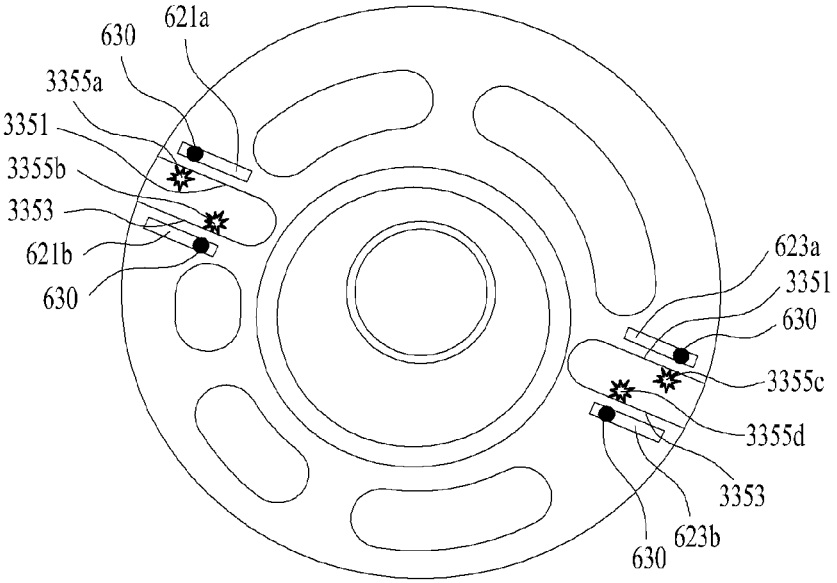
FIGS. 8A and 8B are diagrams showing a state in which the impact-force dissipating member is installed in the key groove according to one embodiment of the present disclosure.

Referring to FIG. 8A, four impact-force dissipating members 630 are located inside the first orbiting deformable groove to the fourth orbiting deformable groove 621*a*, 621*b*, 623*a*, and 623*b* and in a positionally corresponding manner to a first orbiting contact point to a fourth orbiting contact point 3355*a*, 3355*b*, 3355*c*, and 3355*d*, respectively, thereby to reduce the impact force.

In an example, one impact-force dissipating member 630 may be disposed inside the first orbiting deformable groove 621*a* and at a position corresponding to that of the first orbiting contact point 3355*a*. Further, one impact-force dissipating member 630 may be disposed inside the second orbiting deformable groove 621*b*, and at a position corresponding to that of the second orbiting contact point 3355*b*.

More specifically, the impact-force dissipating member 630 being disposed inside the orbiting deformable groove 620 and at a position corresponding to that of the orbiting contact point 3355 may mean that the impact-force dissipating member 630 faces away the orbiting contact point 3355 while the partition wall 337 is interposed therebetween.

For example, the impact-force dissipating member 630 may be disposed at a point where a virtual line extending from the first orbiting contact point 3355*a* on the first face 3351 in a perpendicular manner to the first face 3351 meets the first orbiting deformable groove 621*a*.

The configuration related to the position of the impact-force dissipating member 630 as described above may be equally applied to that of the impact-force dissipating member 630 located inside each of the third orbiting deformable groove 623*a* and the fourth orbiting deformable groove 623*b*.

Figure 8B:
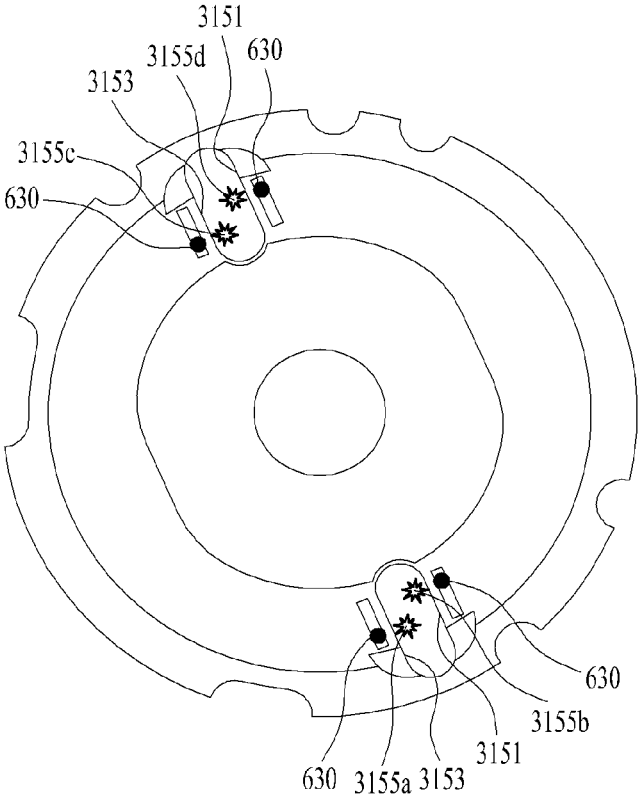

Referring to FIG. 8B, four impact-force dissipating members 630 are located inside the first main deformable groove to the fourth main deformable groove 611*a*, 611*b*, 613*a*, and 613*b* and in a positionally corresponding manner to the first main contact point to the fourth main contact point 3155*a*, 3155*b*, 3155*c*, and 3155*d*, respectively, thereby to reduce the impact force.

As described above based on FIG. 8A, the four impact-force dissipating members 630 may be located inside the first main deformable groove to the fourth main deformable groove 611*a*, 611*b*, 613*a*, and 613*b* and in a positionally corresponding manner to the first main contact point to the fourth main contact point 3155*a*, 3155*b*, 3155*c*, and 3155*d*, respectively, thereby to reduce the impact force.

The configuration related to the position of the impact-force dissipating member 630 is the same as that described above in FIG. 8A, and, thus, descriptions thereof are omitted.

As a result, the impact-force dissipating members 630 may effectively reduce a component of the impact force concentrated on a position corresponding to that of each of the contact points 3155 and 3355 among components of the impact force transmitted to each of the partition walls 317 and 337.

Figure 9A:
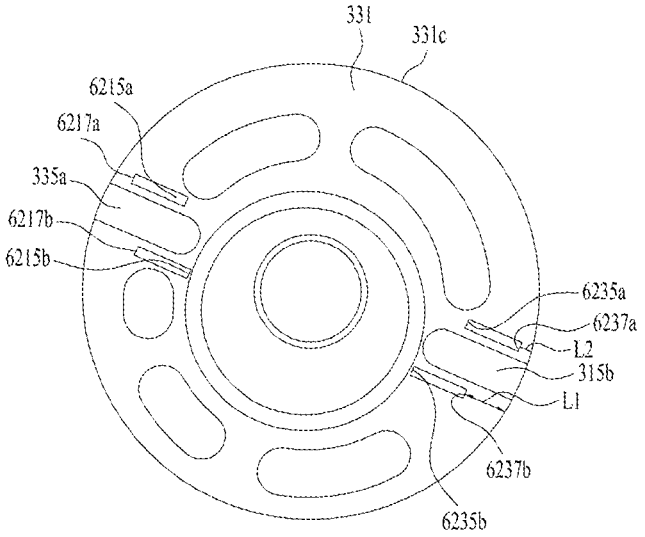
FIGS. 9A and 9B are diagrams showing a state in which a position of the deformable groove is changed according to one embodiment of the present disclosure.
Figure 9B:
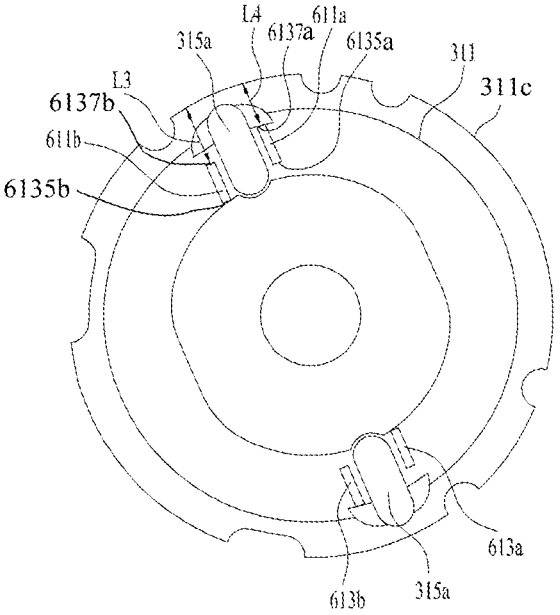

FIGS. 9A and 9B are views showing a state in which positions of two deformable grooves 600 sandwiching each of the key grooves 315 and 335 therebetween are modified.

Referring to FIG. 9A, a spacing from a first orbiting deformable groove 621*a* to the outer side face 331*c* of the orbiting end plate 331 may be different from a spacing from the second orbiting deformable groove 621*b* to the outer side face 331*c* of the orbiting end plate 331.

More specifically, the first orbiting deformable groove 621*a* may be closer to the first face 3351 than to the second face 3353 and extend one end 6215*a* to the other end 6217*a* in parallel with the first face 3351 or the second face 3353. Further, the second orbiting deformable groove 623*b* may be closer to the second face 3353 than to the first face 3351 and may extend from one end 6215*a* to the other end 6217*b* in parallel with the first face 3351 or the second face 3353.

A spacing L1 between the other end 6217*a* of the first orbiting deformable groove 621*a* and the outer side face 331*c* of the orbiting end plate 331 may be different from a spacing L2 between the other end 6217*b* of the second orbiting deformable groove 621*b* and the outer side face 331*c* of the orbiting end plate 331. In this connection, the spacing from the outer side face 331*c* may refer to a spading therefrom in a parallel direction to the first face 3351 or the second face 3353.

When a length of the first orbiting deformable groove 621*a* and a length of the second orbiting deformable groove 621*b* are equal to each other, the spacing L1 between the other end 6217*a* of the first orbiting deformable groove 621*a* and the outer side face 331*c* of the orbiting end plate 331 may be larger or smaller than the spacing L2 between the other end 6217*b* of the second orbiting deformable groove 621*b* and the outer side face 331*c* of the orbiting end plate 331.

Similarly, a spacing between the third orbiting deformable groove 623*a* and the outer side face 331*c* may be different from a spacing between the fourth orbiting deformable groove 623*b* and the outer side face 331*c*.

In this connection, when a length of the third orbiting deformable groove 623*a* and a length of the fourth orbiting deformable groove 623*b* are equal to each other, a spacing between the third orbiting deformable groove 623*a* and the outer side face 331*c* may be larger or smaller than a spacing between the fourth orbiting deformable groove 623*b* and the outer side face 331*c*.

Referring to FIG. 9B, a spacing between the first main deformable groove 611*a* and the outer side face of the main end plate may be different from a spacing the second main deformable groove 611*b* and the outer side face of the main end plate.

In the same manner as described in FIG. 9A, the first main deformable groove 611*a* may include one end 6135*a* and the other end 6137*a*. The second main deformable groove 611*b* may include one end 6135*b* and the other end 6137*b*. Further, a spacing L3 between the other end 6137*a* of the first main deformable groove 611*a* and the outer side face 311*c* may be different from a spacing L4 between the other end 6137*b* of the second main deformable groove 611*b* and the outer side face 311*c*.

The arrangement of the first main deformable groove 611*a* and the second main deformable groove 611*b* are configured in the same manner as those described above in FIG. 9A. Further, the arrangement of the third main deformable groove 613*a* and the fourth main deformable groove 613*b* are configured in the same manner as those described above in FIG. 9A.

Accordingly, a position of each of the contact points 3155 and 3355 may correspond to a center of the length of the deformable groove 600 or may correspond to a position close to the center of the length of the deformable groove 600. Therefore, a component of the impact force concentrated on one point of each of the key grooves 315 and 335 among components of the impact force generated in each of the key grooves 315 and 335 may be effectively reduced.

Effects as not described herein may be derived from the above configurations. The relationship between the above-described components may allow a new effect not achieved in the conventional approach to be derived.

In addition, embodiments shown in the drawings may be modified and implemented in other forms. The modifications should be regarded as falling within a scope of the present disclosure when the modifications is carried out so as to include a component claimed in the claims or within a scope of an equivalent thereto.

What is claimed is:

1. A compressor comprising:

a casing configured to accommodate refrigerant;

a driver coupled to an inner circumferential surface of the casing and configured to rotate a rotatable shaft; and a compression assembly coupled to the rotatable shaft and configured to compress the refrigerant in the casing, the compression assembly comprising:

an orbiting scroll coupled to the rotatable shaft and configured to perform an orbiting motion based on rotation of the rotatable shaft, a fixed scroll engaged with the orbiting scroll and configured to receive the refrigerant and to compress the refrigerant based on the orbiting motion of the orbiting scroll, the fixed scroll being configured to discharge the refrigerant, a main frame that is disposed on the fixed scroll and accommodates the orbiting scroll therein, wherein the rotatable shaft passes through the main frame, and an Oldham's ring comprising:

a ring body that is disposed between the orbiting scroll and the main frame, a first key that protrudes from the ring body and is coupled to the orbiting scroll, wherein the orbiting scroll defines a first key groove that accommodates the first key therein and that is configured to contact the first key based on rotation of the rotatable shaft, and a second key that protrudes from the ring body and is coupled to the main frame, wherein the main frame defines a second key groove that accommodates the second key therein and that is configured to contact the second key based on rotation of the rotatable shaft, and wherein the first and second keys are configured to prevent a spinning motion of the orbiting scroll, wherein at least one of the orbiting scroll or the main frame defines a deformable groove that is spaced apart from the first key groove and the second key groove, the deformable groove being recessed from the at least one of the orbiting scroll or the main frame.

2. The compressor of claim 1, wherein the first key groove has a first contact point disposed at an inner surface of the first key groove and configured to contact the first key based on rotation of the rotatable shaft, wherein the second key groove has a second contact point disposed at an inner surface of the second key groove and configured to contact the second key based on rotation of the rotatable shaft, and wherein the deformable groove extends parallel to the first key groove or the second key groove and is configured to deform at a position corresponding to the first contact point or the second contact point based on rotation of the rotatable shaft.

3. The compressor of claim 1, wherein each of the first key groove, the second key groove, and the deformable groove is recessed in a axial direction of the rotatable shaft, and wherein a depth of each of the first key groove and the second key groove in the axial direction is less than a depth of the deformable groove in the axial direction.

4. The compressor of claim 1, wherein the deformable groove extends in a radial direction of the orbiting scroll or the main frame, and wherein a length of the deformable groove in the radial direction is greater than a width of the deformable groove in a width direction perpendicular to the radial direction.

5. The compressor of claim 4, wherein the deformable groove comprises a curved surface configured to deform based on rotation of the rotatable shaft.

6. The compressor of claim 5, wherein the curved surface is disposed at an end of the deformable groove in the radial direction.

7. The compressor of claim 1, wherein the compression assembly further comprises an impact-force dissipating member disposed in the deformable groove and made of a polymer material or rubber.

8. The compressor of claim 7, wherein the first key groove has a first contact point disposed at an inner surface of the first key groove and configured to contact the first key based on rotation of the rotatable shaft, wherein the second key groove has a second contact point disposed at an inner surface of the second key groove and configured to contact the second key based on rotation of the rotatable shaft, and wherein the impact-force dissipating member is disposed in the deformable groove at position corresponding to the first contact point or the second contact point.

9. The compressor of claim 1, wherein the main frame comprises:

a main end plate that receives the rotatable shaft; and a main side plate that protrudes from the main end plate toward the fixed scroll and is supported on the fixed scroll, and wherein the second key groove is a main key groove defined in the main end plate.

10. The compressor of claim 9, wherein the main end plate has:

a first surface in contact with the ring body;

a second surface that is opposite to the first surface of the main end plate and spaced apart from the ring body; and an outer side surface that extends between the first surface and the second surface of the main end plate and is connected to an outer surface of the main side plate, and wherein the deformable groove comprises a main deformable groove that is defined in the main end plate, that extends parallel to the main key groove, and that is spaced apart from the outer side surface of the main end plate.

11. The compressor of claim 10, wherein the main key groove has:

a first plane; and a second plane that is spaced apart from the first plane and extends parallel to the first plane, wherein the main deformable groove comprises a first main deformable groove disposed closer to the first plane than to the second plane, and a second main deformable groove disposed closer to the second plane than to the first plane, and wherein the main key groove is disposed between the first main deformable groove and the second main deformable groove.

12. The compressor of claim 11, wherein each of the first plane, the second plane, the first main deformable groove, and the second main deformable groove extends in a radial direction of the main frame.

13. The compressor of claim 11, wherein each of the first main deformable groove and the second main deformable groove extends from an inner end to an outer end toward the outer side surface, and wherein a first spacing between the outer end of the first main deformable groove and the outer side surface is different from a second spacing between the outer end of the second main deformable groove and the outer side surface.

14. The compressor of claim 1, wherein the orbiting scroll comprises:

an orbiting end plate disposed between the main frame and the fixed scroll; and an orbiting wrap that extends from the orbiting end plate toward the fixed scroll and defines a compression chamber together with the fixed scroll, the compression chamber being configured to receive and compress the refrigerant, and wherein the first key groove is an orbiting key groove defined in the orbiting end plate.

15. The compressor of claim 14, wherein the orbiting end plate has:

a first surface in contact with the ring body;

a second surface that is opposite to the first surface and spaced apart from the first surface, wherein the orbiting wrap extends from the second surface; and an outer side surface that extends between the first surface and the second surface of the orbiting end plate, and wherein the deformable groove comprises an orbiting deformable groove that is defined in the orbiting end plate, that extends parallel to the orbiting key groove, and that is spaced apart from the outer side surface of the orbiting end plate.

16. The compressor of claim 14, wherein the orbiting end plate has:

a first surface in contact with the ring body;

a second surface that is opposite to the first surface and spaced apart from the first surface, wherein the orbiting wrap extends from the second surface; and an outer side surface that extends between the first surface and the second surface of the orbiting end plate, and wherein the deformable groove is defined in the orbiting end plate, extends in a parallel manner to the orbiting key groove, and passes through the outer side surface.

17. The compressor of claim 16, wherein the deformable groove is recessed from the outer side surface of the orbiting end plate and extends radially inward along a radial direction of the orbiting end plate.

18. The compressor of claim 15, wherein the orbiting key groove has:

a first plane; and a second plane that is spaced apart from the first plane and extends parallel to the first plane, wherein the orbiting deformable groove comprises a first orbiting deformable groove disposed closer to the first plane than to the second plane, and a second orbiting deformable groove disposed closer to the second plane than to the first plane, and wherein the orbiting key groove is disposed between the first orbiting deformable groove and the second orbiting deformable groove.

19. The compressor of claim 18, wherein each of the first orbiting deformable groove and the second orbiting deformable groove extends from an inner end to an outer end toward the outer side surface, and wherein a first spacing between the outer end of the first orbiting deformable groove and the outer side surface is different from a second spacing between the outer end of the second orbiting deformable groove and the outer side surface.

20. The compressor of claim 1, wherein the main frame comprises:

a main end plate that receives the rotatable shaft; and a main side plate that protrudes from the main end plate toward the fixed scroll and is supported on the fixed scroll, wherein the second key groove is a main key groove defined in the main end plate, and wherein the deformable groove comprises at least one main deformable groove that is defined in the main end plate and spaced apart from the main key groove.

21. The compressor of claim 20, wherein the at least one main deformable groove comprises main deformable grooves that are disposed on both sides of the main key groove and spaced apart from the main key groove.

22. The compressor of claim 1, wherein the orbiting scroll comprises:

an orbiting end plate disposed between the main frame and the fixed scroll; and an orbiting wrap that extends from the orbiting end plate toward the fixed scroll and defines a compression chamber together with the fixed scroll, the compression chamber being configured to receive and compress the refrigerant, wherein the first key groove is an orbiting key groove defined in the orbiting end plate, and wherein the deformable groove comprises at least one orbiting deformable groove that is defined in the orbiting end plate and spaced apart from the orbiting key groove.

23. The compressor of claim 22, wherein the at least one orbiting deformable groove comprises orbiting deformable grooves that are disposed on both sides of the orbiting key groove and spaced apart from the orbiting key groove.

* * * * *